United States Patent [19]

Harada

[11] Patent Number: 4,993,713

[45] Date of Patent: Feb. 19, 1991

[54] GAME MACHINE

[75] Inventor: Masamichi Harada, Tokyo, Japan

[73] Assignee: Kabushiki Kaisha Universal, Tochigi, Japan

[21] Appl. No.: 307,130

[22] Filed: Feb. 3, 1989

[30] Foreign Application Priority Data

Feb. 3, 1988 [JP] Japan ..... 63-22993

[51] Int. Cl.[5] ..... A63B 71/00; A63F 1/00; G07F 17/32

[52] U.S. Cl. ..... 273/138 A; 273/85 CP; 273/143 R

[58] Field of Search ..... 273/138 A, 143 R, 85 CP; 364/412

[56] References Cited

U.S. PATENT DOCUMENTS

| | | | |
|---|---|---|---|
| 4,216,461 | 8/1980 | Werth etal. | 273/143 R |
| 4,573,681 | 3/1986 | Okada | 273/143 R |
| 4,657,256 | 4/1987 | Okada | 273/138 A |
| 4,669,731 | 6/1987 | Clark | 273/138 A |
| 4,679,143 | 7/1987 | Hagiwara | 273/138 A |
| 4,700,948 | 10/1987 | Okada | 273/143 R |

FOREIGN PATENT DOCUMENTS

| | | | |
|---|---|---|---|
| 142371 | 5/1985 | European Pat. Off. . | |
| 189256 | 7/1986 | European Pat. Off. . | |
| 2928643 | 2/1981 | Fed. Rep. of Germany . | |
| 3426431 | 1/1986 | Fed. Rep. of Germany . | |
| 542484 | 11/1973 | Switzerland . | |
| 2165386 | 4/1988 | United Kingdom | 273/143 R |

*Primary Examiner*—Edward M. Coven
*Assistant Examiner*—Jessica J. Harrison
*Attorney, Agent, or Firm*—Young & Thompson

[57] ABSTRACT

A game machine comprises hit flag counters which count up each hit request and count down upon the occurrence of each hit game. In these hit flag counters, if a hit cannot occur in spite of a hit request, the hit request is stored for the following games until the corresponding hit is obtained. A hit can be obtained only when the number of stored hit requests is not less than the number of inserted coins, so that the pay-out rate of the game machine is exactly controlled to be constant in totality.

9 Claims, 3 Drawing Sheets

GAME MACHINE

BACKGROUND OF THE INVENTION

The present invention relates to game machines, and more particularly to coin-operated game machines in which players can play a game by inserting coins (including tokens).

As coin-operated game machines, slot machines and poker game machines are well known. In a video-type poker game machine, for example, five cards are displayed on a CRT screen, these cards being changed when a start lever is actuated after an optional number of coins are inserted. The changing of the cards is caused to stop automatically or upon pushing a stop button. A hit, that is, the winning of a prize, is determined based on the combination of five cards that is finally displayed on the CRT screen. The number of coins paid out for a hit depends on not only the rank of the obtained hit card combination but also the number of inserted coins. The number of paid out coins becomes larger, the larger is the number of inserted coins. Ordinarily, the number of delivered coins is multiplied by the number of inserted coins for the same hit card combination.

Recently, coin-operated game machines have been provided with microcomputers, by which the probability of obtaining a hit is so controlled as to maintain a nearly constant pay-out rate; for each game, a random value is sampled from a random number generator for comparison with a prize-winning or probability table in order to determine whether the present game is to be set as a hit game, that is, a prize-winning game, and if so, what kind of hit is to occur, and the microcomputer then executes game processing according to a hit game or lost game processing program. In this way, the probability of obtaining a hit can be kept nearly constant because the number of random values corresponding to hits can be predetermined in relation to the number of all random values to be generated by the random number generator.

In this type of coin-operated game machine, if a sampled random value is found to correspond to a hit as a result of comparison with the hit probability table, a hit flag is generated so as to execute hit game processing which makes it easier to obtain a hit. But a hit does not always result from setting a hit flag. For example, in a game machine with hold buttons as disclosed in U.S. Pat. No. 4,700,948, in which a player can move once more any selected symbols after the first stopping of all symbols when the symbol combination displayed at the time of the first stop does not correspond to a hit combination, if the combination sought by actuating the hold buttons does not match the hit symbol combination decided by the microcomputer, a hit cannot occur. It can also be applied in case of a game machine with stop buttons as disclosed in U.S. Pat. No. 4,573,681 if the actuation of the stop buttons were extremely ill-timed. In such a case, the hit flag is stored for the following games in order to keep the pay-out rate constant, so that the following games continue to be processed according to the hit game program until the corresponding hit is obtained.

Such coin-operated game machines, wherein an unsatisfied hit request is held over for one of the following games, has the problem that if a hit game is obtained when a large number of coins have been inserted while a hit request is carried over from the prior game played with only a small number of inserted coins, the number of coins paid out at that time becomes too large due to its proportionality to the number of inserted coins, so that the pay-out rate exceeds the predetermined rate. For example, if players intentionally repeat the game while inserting only one coin and actuating the hold buttons or stop buttons so as not to obtain a hit, and thereafter insert a larger number of coins choosing a time when a hit flag is considered to be set, a great number of coins would be delivered at high probability. Therefore the pay-out rate cannot be exactly controlled.

OBJECT OF THE INVENTION

It is therefore an object of the present invention to provide a game machine whose pay-out rate can be kept constant irrespective of the number of inserted coins.

SUMMARY OF THE INVENTION

For achieving the above and other objects and advantages, in accordance with the present invention, a game machine comprises a coin counter for counting the number of inserted coins, means for counting the number of the hit requests, and judging means for comparing the count of the coin counter with the count of the hit request counting means and for authorizing the execution of the hit request so long as the former count is not more than the latter.

According to the game machine of this invention, even if a hit request is kept effective, the hit request is not executed when the number of inserted coins is greater than the number of effective hit requests, thereby to prevent the pay-out rate from exceeding a predetermined rate.

BRIEF DESCRIPTION OF THE DRAWINGS

These and other objects and advantages of the invention will be easily understood by referring to the following description and accompanying drawings in which.

DETAILED DESCRIPTION OF THE INVENTION

Figure 3:
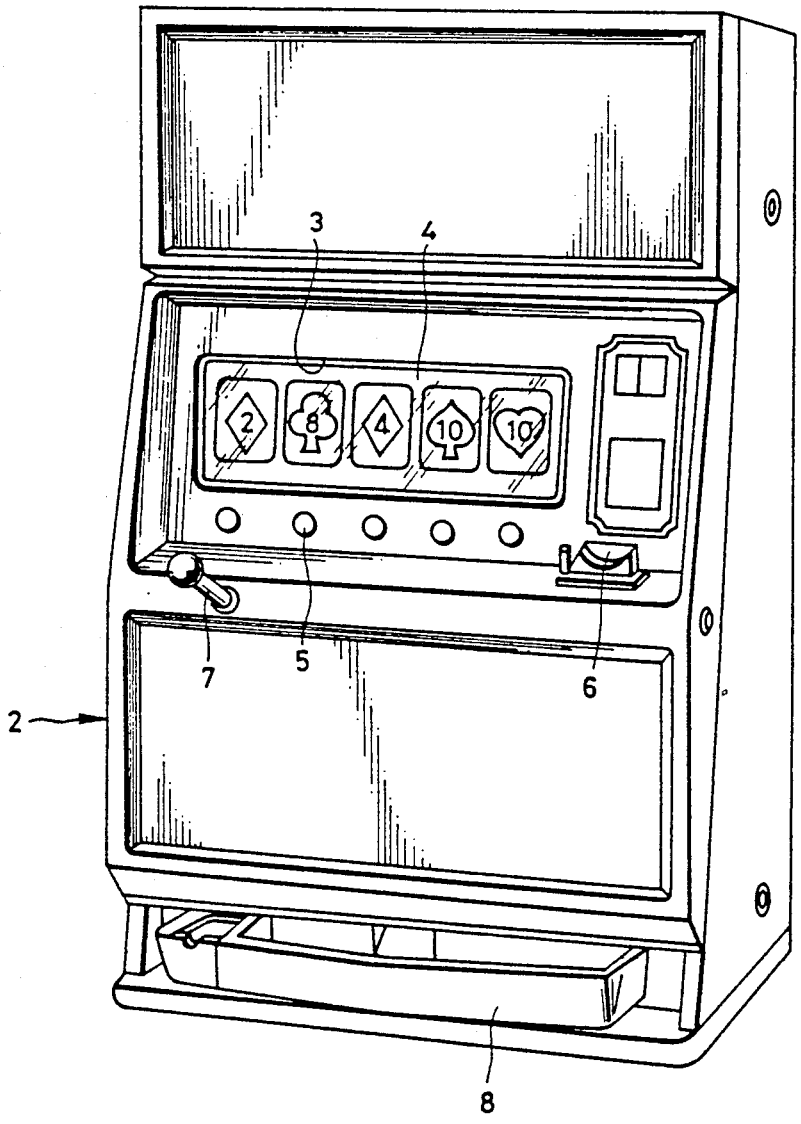
FIG. 3 is a perspective view showing a poker game machine embodying the present invention.

Referring to FIG. 3 showing the external appearance of a poker game machine embodying the present invention, a machine body 2 is provided at its front surface with a display window 3, through which a screen 4 of a CRT display 14 built into the machine body 2 can be observed. The CRT screen 4 displays a row of five cards arranged side by side thereon. Under each card display position there is provided a respective corresponding hold button 5 on the machine body surface. It is possible also to use a liquid crystal display panel, a plasma display panel or the like as the display unit.

Prior to starting a game, coins are inserted into a coin slot 6. When a start lever 7 is actuated, the CRT screen 4 displays five series of cards moving vertically. Thereafter the cards stop at random automatically. If a combination of stopped cards displayed on the CRT screen 4 comprises a hit combination in the poker game, a number of coins are paid out into a coin saucer 8, the number being determined based on the rank of that hit card combination multiplied by the number of inserted coins.

Figure 1:
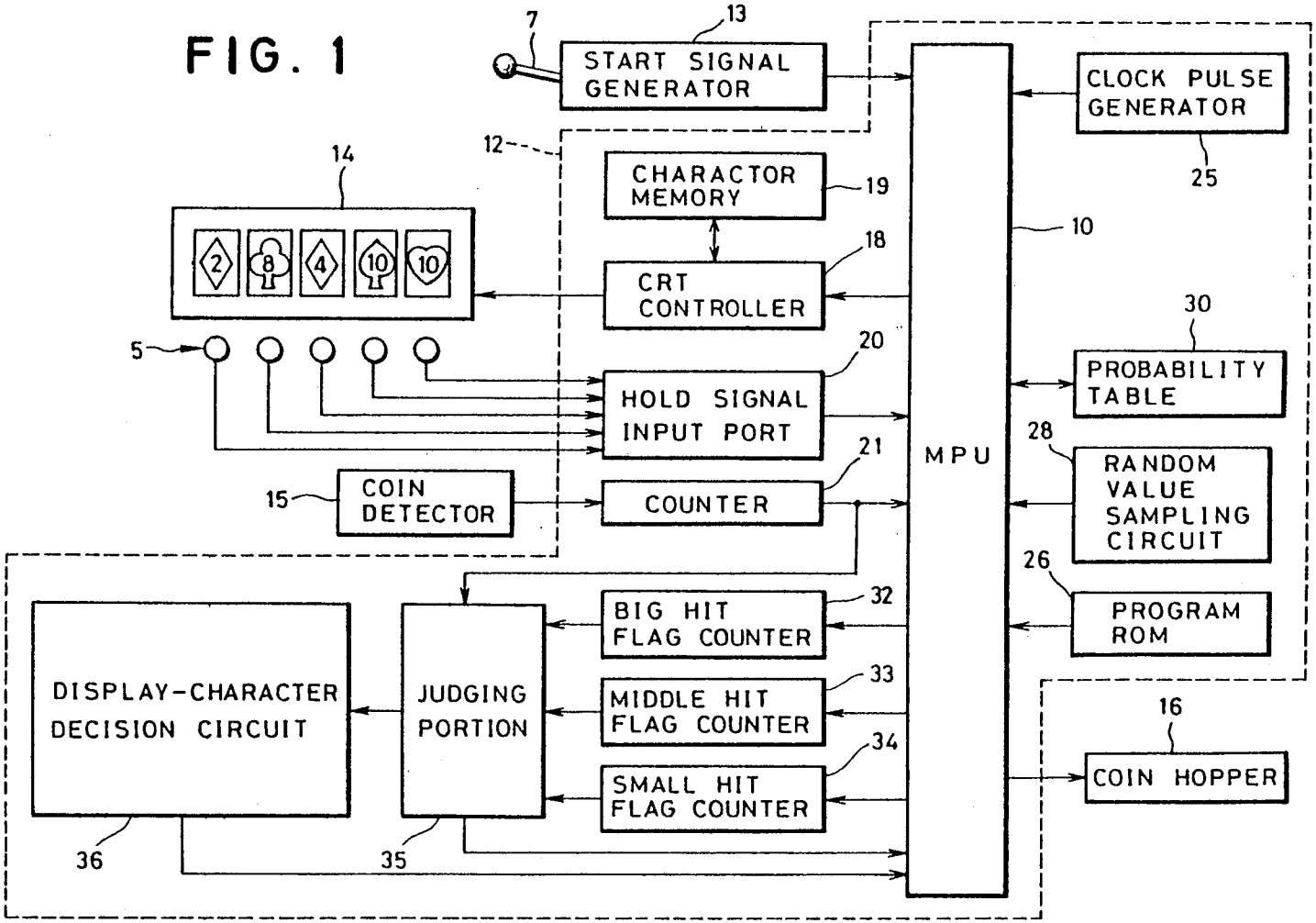
FIG. 1 is a block diagram showing circuit arrangements of an embodiment of a poker game machine according to the present invention.

Referring now to FIG. 1, the poker game machine comprises a microcomputer 12 having a microprocessor unit (hereinafter referred to as an MPU) 10, to which a start signal generator 13, the CRT display 14, the hold buttons 5, a coin detector 15, and a coin hopper 16 are connected. Responsive to the start lever actuation, the start signal generator 13 supplies a start signal to the MPU 10, which then controls the CRT 14 to display the cards moving on its screen 4 via a CRT controller 18 and a character memory 19.

The hold buttons 5 are used to designate the cards to be kept back on a card exchange. When any of the hold buttons 5 is pushed, corresponding hold signals are input into the MPU 10 via a hold signal input port 20, whereby designated cards are not moved but remain displayed after the start lever 7 is again actuated. This card exchange operation can be carried out as a second round in every game without inserting additional coins, when no hit card combination has been obtained in the first round of the game. This card exchange operation can be effected only once per game without sampling a new random number, so that a player must again insert coins if he wants to play the next game. If a hit card combination is obtained in the first round of a game, the player is not allowed to perform card exchange, but must again insert coins for playing the next game.

The coin detector 15 gives a signal each time a coin is inserted into the coin slot 6, and this signal is counted by a counter 21. The coin hopper 16 pays out a number of coins responsive to a signal from the MPU 10 when a hit is obtained, the number of paid-out coins being determined based on the rank of the obtained hit card combination as well as the coin count of the coin counter 21.

A clock pulse generator 25 supplies clock pulses to the MPU 10 in a well-known manner, thereby to effect game processing according to the timing of the clock pulses. Programs for game processing are stored in a program memory, such as a ROM 26. A random value sampling circuit 28 samples a random number within a predetermined range during the first round of every game. The same random number cannot be again sampled until all the other random numbers have been sampled, as long as the power source of the poker game machine is not turned off.

A probability table 30 comprises a ROM having four memory areas each of which corresponds to a big, middle and small hit area, and a lost game area in a range of the random numbers. For example, when the random numbers to be sampled are in the range from "0" to "10000", the range from "0" to "50" is assigned to the big hit area, the range 51 to 250 to the middle hit area, the range "251" to "1500" to the small hit area, and the other random numbers to the lost game area. The big hit is assigned to such hit card combinations as "straight flush" which should occur with the lowest probability; the middle hit is assigned to such hit card combinations as "flush" or "full house" which should occur with lower probability; and the small hit is assigned to such hit card combinations as "one pair" or "two pairs" which should occur with relatively high probability. If a sampled random number is within the range corresponding to the big hit area, the MPU 10 sends big hit flag to a big hit flag counter 32, which then counts up one count.

Besides the big hit flag counter 32, a middle hit flag counter 33 and a small hit flag counter 34 are provided to count the number of generated hit flags by area, whose counts are supplied to a judging portion 35. As will be described later in detail, if, at the start of a game, any of the flag counters 32, 33 and 34 is already set to "1" or more by the foregoing hit flags, the MPU 10 performs hit game processing so that a hit card combination corresponding to one of the stored hit flags occurs even if the random number sampled during the present game is not within the hit area, so long as the judging portion 35 detects that the number of inserted coins fills predetermined requirements. In other words, once a hit flag is generated, the hit flag is kept effective during following games until a corresponding hit is obtained.

It is to be noted that there are two types of big, middle and small hits. The first type of hits occurs upon one actuation of the start lever 7, while the second type of hits occurs after card exchange upon pushing the hold buttons 5, as a second round. In the case of the second type of hit, a card combination is displayed during the first round from which a player can directly or indirectly deduce a hit card combination intended to be displayed by the microcomputer. Which type of hit should occur is selected according to the random number sampled in the first round. Of course, it may be possible to determine the type to be selected by using other random selecting means. If, in spite of a second type of hit being requested, no big hit should occur because of a wrong choice of hold buttons 5, the count of the corresponding hit counter is kept unchanged and is carried over to the following games.

The judging portion 35 sends instructions to a display-character decision circuit 36, which then decides the characters to be displayed as a big, middle or small hit card combination, or a lost game card combination, responsive to those instructions. The display-character decision circuit 36 designates via the MPU 10 the addresses in a character memory 19 corresponding to the decided characters.

In case only those card combinations whose ranks are higher than a pair of jacks are predetermined as the hit card combinations, the card combination shown in FIGS. 1 and 3 does not correspond to a hit card combination. In this case, a player may push, for example, the first and second hold buttons on the right prior to again actuating the start lever 7 for the second round of a game (card exchange) so that he can obtain three tens, whereby only three cards on the left are caused to move and stop automatically. If the display-character decision circuit 36 decides to display a combination including three tens, the player has a hit, and hence the proper number of coins are paid out in the same manner as above. If, however, the buttons 5 are pushed in some other manner, the game will be a lost game, and hence the hit flag will be stored for the following game.

Figure 2:
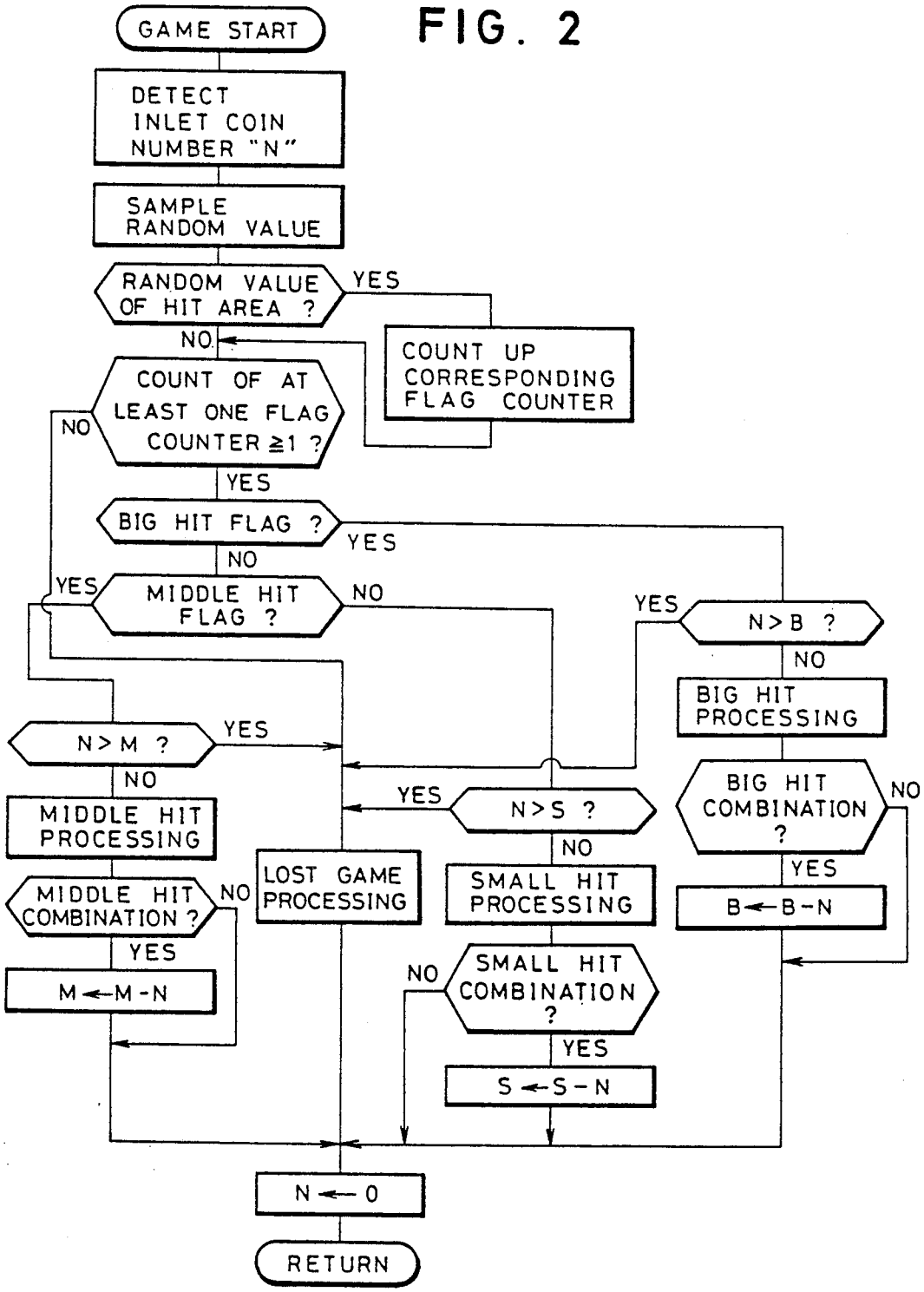
FIG. 2 is a flow chart showing an example of a game process of the poker game machine of FIG. 1.

The operation of the above-described poker game machine will now be described with reference to the flow chart of FIG. 2.

When a number of coins are inserted into the coin slot 6, the inserted coin number "N" is registered in the counter 21. Upon actuating the start lever 7, the MPU 10 starts processing according to the game program in the program ROM 26, thereby to display five series of cards moving vertically on the screen 4 of the CRT 14.

As soon as the first round of a game is started, the random value sampling circuit 28 samples a random number, and to what area the sampled random number belongs is determined by referring to the probability table 30. If the random number belongs to any one of the hit areas, e.g. the big hit area, corresponding big hit flag counter 32 counts up by one count. In FIG. 2, "B", "M" and "S" indicate the counts of the big, middle and small hit flag counters 32, 33 and 34, respectively.

Thereafter, the judging portion 35 determines whether at least one hit flag counter 32, 33, 34 is set to "1" or more. Even if no hit flag is generated in the present game, if any one of the hit flag counters is still set to "1" or more, the count thereof is detected and compared with the count of the counter 21. Needless to say, in case no foregoing hit flag is stored for the present game, and a new hit flag is generated, the new hit flag would be effective.

If the counts of all hit flag counters 32, 33 and 34 are "0", lost game processing is executed according to the lost game processing program stored in the program memory 26, whereby the CRT controller 18 controls the CRT 14 to display a combination of cards corresponding to none of the possible hits, on the CRT screen 14 after stopping of the card movement. In this case, a player could not obtain a hit even if he were to push several hold buttons 5 and actuate the start lever 7 for card exchange. It is possible to store several numbers of lost game combination patterns in the display character decision circuit 36.

If any of the hit flag counters 32, 33 and 34, for example the big hit flag counter 32, is set to "1" or more, the judging portion 35 compares the count "1" of the big hit flag counter 32 with the number of coins "N" inserted at the beginning of a game. If the number N is larger than "1", the judging portion 35 gives a lost game processing instruction to the MPU 10, which then executes the lost game processing in the same manner as above. Also in this case, no hit could occur even though a card exchange would be carried out after pushing the hold buttons 5.

If the number of inserted coins "N" is "1" when the big hit flag counter 32 is set to "1", the judging portion 5 gives a big hit game processing instruction to the MPU 10 and the display-character decision circuit 36, whereby a combination of cards corresponding to a big hit is displayed on the CRT screen 4 in the first or second round, and the coin hopper 16 pays out coins of a number depending on the rank of the big hit combination. At the end of the game, the count B of the big hit flag counter 32 is reduced by the number of inserted coins "N", namely the big hit flag counter 32 is reset to "0", and the counter 21 is also reset "0". When the count B of the big hit flag counter 32 is "2", the counters 32 and 21 are reset to "0" if the number of inserted coins "N" is "2", but if the number of inserted coins "N" is "1", the big hit flag counter 32 count down to "1" at the end of the game.

The same game process as in the case of the big hit flag is executed when the middle hit flag counter 33 or the small hit flag counter 34 is set to "1" or by the middle or small hit flag, respectively. Namely, when the count "N" of the counter 21 is not more than the count "M" of the middle hit flag counter 33 or the count "S" of the small hit flag counter 34, the middle or small hit processing is executed, and the middle or small hit flag is kept effective until the corresponding hit card combination is obtained.

In case of many hit flag counters 32, 33 and 34 being set to "1" or more, priority is given to the big, middle and small hits in this order, but it may be possible to give priority to the sequence of hit flag occurrence instead of to the kind of hit. In other words, when more than one hit flag counter is set to different counts and one of these hit flag counters has a count suitable for the number of inserted coins, the hit corresponding to that one hit flag counter occurs. For this hit game processing, the flow chart shown in FIG. 2 should be so changed that the number "N" of inserted coins is compared with the count "M" of the middle hit flag counter when the number "N" is larger than the count "B" of the big hit flag counter and the number "N" is compared with the count "S" of the small hit flag counter when the number "N" is larger than the count "M".

According to the above-described game machine, a big or middle hit would not occur in the case of a large number of coins, for example 20 coins, being inserted, even after many games have been repeatedly played with a small number of coins, for example one coin, while intentionally ill-selecting the hold buttons, because the big or middle hit flag counter 32 or 33 does not usually count up to "20".

It can happen that the small hit flag counter 34 counts up to "20" or more after the repetition of the above-intentional lost game manipulation. In this case, a small hit would occur also when a game is played with 20 inserted coins. At this time, however, the count of the small hit flag counter 34 is reduced by the number of inserted coins so that a small hit would not occur twice in a row when playing a game again with 20 inserted coins.

On the other hand, when a player continues to play a game by inserting a coin after the count of the small hit flag counter 34 has reached "20", at least twenty small hits can continuously occur. But the sum of the delivered coins is equal to the number of coins delivered at once on playing a game by inserting 20 pieces of coins. Consequently, the pay-out rate can be kept constant in any case.

Although the above embodiment is a poker game machine provided with hold buttons, the present invention can be applicable not only to a poker game machine but also to any kind of game machine, such as slot machines with stop buttons, in which coins are used to play a game and a hit request is given by a microcomputer. Obviously many modifications and variations of the present invention are possible in the light of the above teachings. It is therefore to be understood that within the scope of the appended claims the invention can be practiced otherwise than as specifically described.

What is claimed is:

1. A game machine having a microprocessor unit for controlling a game process and means for generating a hit request which effects hit game processing, wherein a number of coins are inserted at the beginning of a game, the award for a hit game depends on the number of inserted coins, and when a game results in a lost game in spite of a hit request being generated, said hit request is carried over for the following game, said game machine further comprising:

a coin counter for counting the number of inserted coins;

means for counting the number of said hit requests; and judging means for comparing the count of said coin counter with the count of said hit request counting means and for effecting hit game processing only when the count of said coin counter is not more than the count of said hit request counting means.

2. A game machine as defined in claim 1, wherein said hit request generating means comprises a random value sampling circuit for sampling a random value from a predetermined random value range, a probability table for storing relationships between random values and a plurality of different kinds of hits, said probability table deciding the kind of hit to be processed in accordance with a sampled random number: and said hit request counting means comprising a plurality of hit flag counters each of which counts up each kind of said hit request.

3. A game machine as defined in claim 2, wherein said kind of hits includes a big hit for which a largest number of coins are delivered, a middle hit for which an intermediate number of coins are delivered, and a small hit for which a small number of coins are delivered.

4. A game machine as defined in claim 2, wherein as long as at least one of said plurality of hit flag counters is set to at least one, said judging means compares the count of said at least one hit flag counter with the count of said coin counter, and executes a hit of a kind corresponding to one of said hit flag counters having a count at least equal to one only when the count of this hit flag counter is not less than the count of said coin counter.

5. A game machine as defined in claim 4, wherein when the counts of more than one of said plurality of hit flag counters are at least one, a corresponding hit is allowed to occur according to a predetermined priority.

6. A game machine as defined in claim 1, wherein said game machine further comprises hold buttons for keeping any selected character displayed within a display window of said game machine or exchanging the displayed character for another character, said displayed character exchange being adapted to be carried out as a second round of a game without inserting additional coins, and the same instruction from said judging means being used for the second round as for the first round.

7. A game machine as defined in claim 6, wherein said hit requests include two types of hit requests, one for hits during the first round, the other for hits during the second round.

8. A game machine having a microprocessor unit for controlling a game process and means for generating a hit request which effects hit game processing, wherein a number of coins are inserted at the beginning of a game, the award for a hit game depends on the number of inserted coins, and when a game results in a lost game in spite of a hit request being generated, said hit request is carried over for the following game, said game machine further comprising:

a coin counter for supplying a count representative of the number of inserted coins;

means for counting the number of said hit requests; and judging means for comparing the count of said coin counter with the count of said hit request counting means and for effecting hit game processing only when the count of said coin counter is not more than the count of said hit request counting means.

9. A game machine having a microprocessor unit for controlling a game process and means for generating a hit request which effects hit game processing, wherein a number of coins are inserted at the beginning of a game, the award for a hit game depends on the number of inserted coins, and when a game results in a lost game in spite of a hit request being generated, said hit request is carried over for the following game, said game machine further comprising:

a coin counter for supplying a count representative of the number of inserted coins;

means for counting the number of said hit requests; and judging means for comparing the count of said coin counter with the count of said hit request counting means and for effecting hit game processing only when the count of said coin counter bears a predetermined relationship to the count of said hit request counting means.

* * * * *